US005732421A

United States Patent [19]

Scherberger

[11] Patent Number: 5,732,421

[45] Date of Patent: Mar. 31, 1998

[54] SHOWER SEAT

[76] Inventor: Lutz A. Scherberger, 227 Lehigh Dr., Richboro, Pa. 18954

[21] Appl. No.: 593,519

[22] Filed: Jan. 30, 1996

[51] Int. Cl.[6] ..... A47K 3/22

[52] U.S. Cl. ..... 4/611; 4/597; 4/604; 4/571.1; 248/220.1

[58] Field of Search ..... 4/611, 596, 597, 4/604, 605, 496, 571.1, 578.1, 590; 108/42; 248/220.1

[56] References Cited

U.S. PATENT DOCUMENTS

| | | | |
|---|---|---|---|
| 2,096,024 | 10/1937 | Anderson | 248/220.1 |
| 2,261,078 | 10/1941 | Shockey | 108/42 |
| 2,700,475 | 1/1955 | Salter | 108/42 |
| 3,193,848 | 7/1965 | Levy | 4/611 |
| 4,708,310 | 11/1987 | Smith | 248/220.1 |
| 5,224,224 | 7/1993 | Hintz et al. | 4/578.1 |
| 5,341,528 | 8/1994 | Sultzbaugh | 4/611 |

*Primary Examiner*—David J. Walczak
*Attorney, Agent, or Firm*—Zachary T. Wobensmith, III

[57] ABSTRACT

A solid material corner seat for use in an existing shower stall or tub enclosure which is of generally trapezoidal configuration, spaced from the enclosure walls, and removably retained to brackets fastened to the walls, with openings in the seat to allow water to pass therethrough, and which is of laminated plastic construction.

4 Claims, 5 Drawing Sheets

SHOWER SEAT

BACKGROUND OF THE INVENTION

1. Field of the Invention

This invention relates to a removable trapezoidal shaped solid material seat for use in the corner of an existing shower stall or tub enclosure.

2. Description of the Prior Art

In most existing shower or tub enclosures there aren't adequate provisions for persons who wish to sit down during bathing, either due to physical problems, or for comfort. Due to the moisture level present, it is desirable that no standing water remain after bathing, and that the structures be easy to clean and maintain. Various structures have been provided for tub and shower enclosures, some of which purported to provide resting surfaces for bathers, but none of them is believed to be completely satisfactory. Examples of such structures are illustrated in the U.S. Patents to Levy U.S. Pat. No. 3,193,848; Smith U.S. Pat. No. 4,987,619; Romano U.S. Pat. No. 5,065,462; Hintz et al U.S. Pat. No. 5,224,224 and Sultzbaugh U.S. Pat. No. 5,341,528.

The corner seat of the invention does not suffer from the problems of prior art structures, and provides many positive advantages.

SUMMARY OF THE INVENTION

It has now been found that a solid material corner seat for a shower stall or tub enclosure is available, that is of a generally trapezoidal shape, that can be removably mounted to the walls of the shower stall or tub enclosure, is easy to clean and is formed of a laminated plastic material.

The principal object of the invention is to provide a corner seat for a shower stall or tub enclosure that is easy to use and is of sturdy, long lasting construction.

A further object of the invention is to provide a seat that can be easily attached and detached.

A further object of the invention is to provide a seat which is constructed of laminated plastic.

A further object of the invention is to provide a seat that can be made in a variety of colors.

A further object of the invention is to provide a seat that is useful by handicapped persons.

A further object of the invention is to provide a seat that can be used in a variety of shower and tub installations.

A further object of the invention is to provide a seat that is easy to clean, and does not retain standing water.

Other objects and advantageous features of the invention will be apparent from the description and claims.

DESCRIPTION OF THE DRAWINGS

The nature and characteristic features of the invention will be more readily understood from the following drawings taken in connection with the accompanying description and claims in which:

Figure 1:
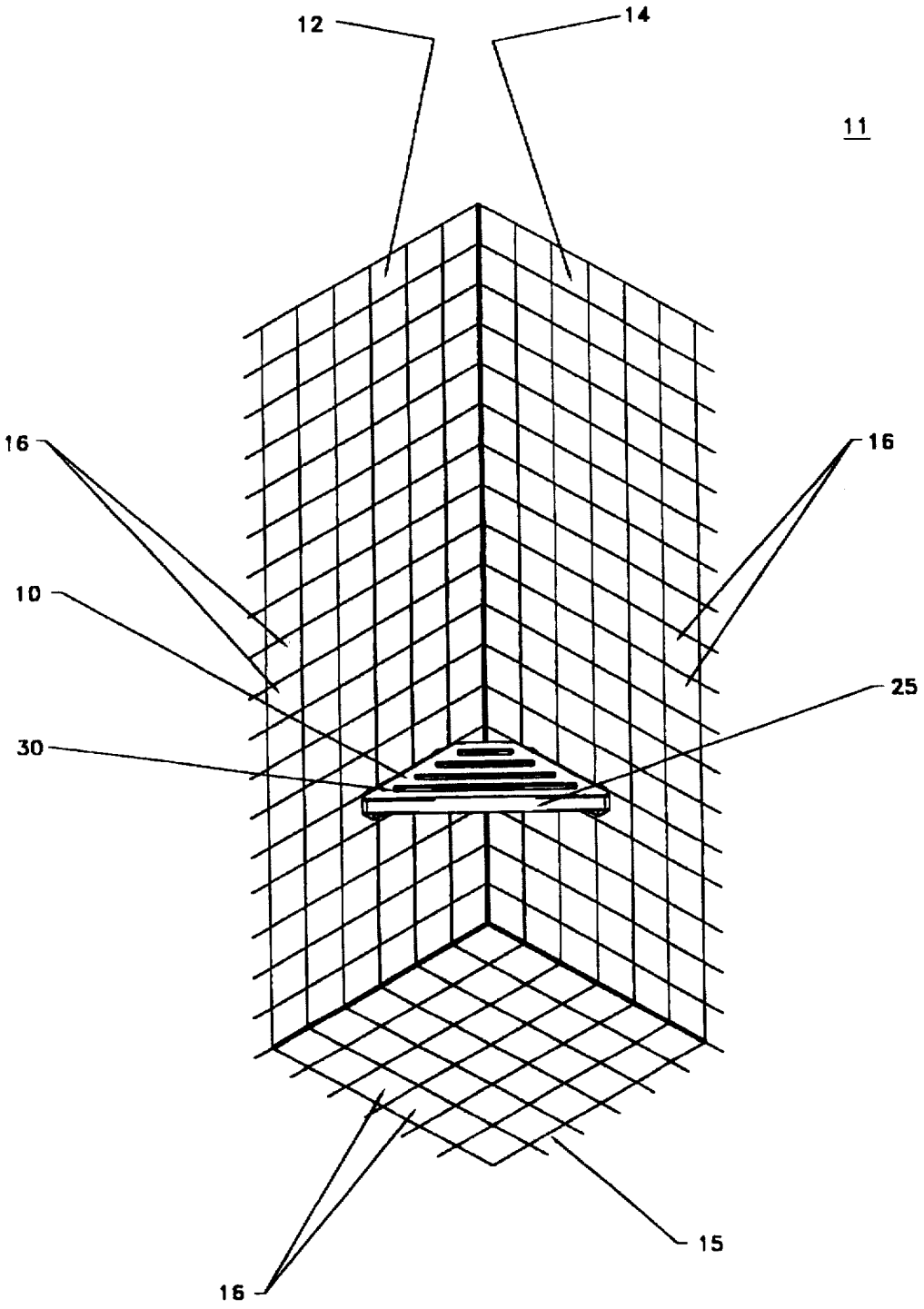
FIG. 1 is a perspective view of one embodiment of the corner seat of the invention in place in a shower stall.
Figure 2:
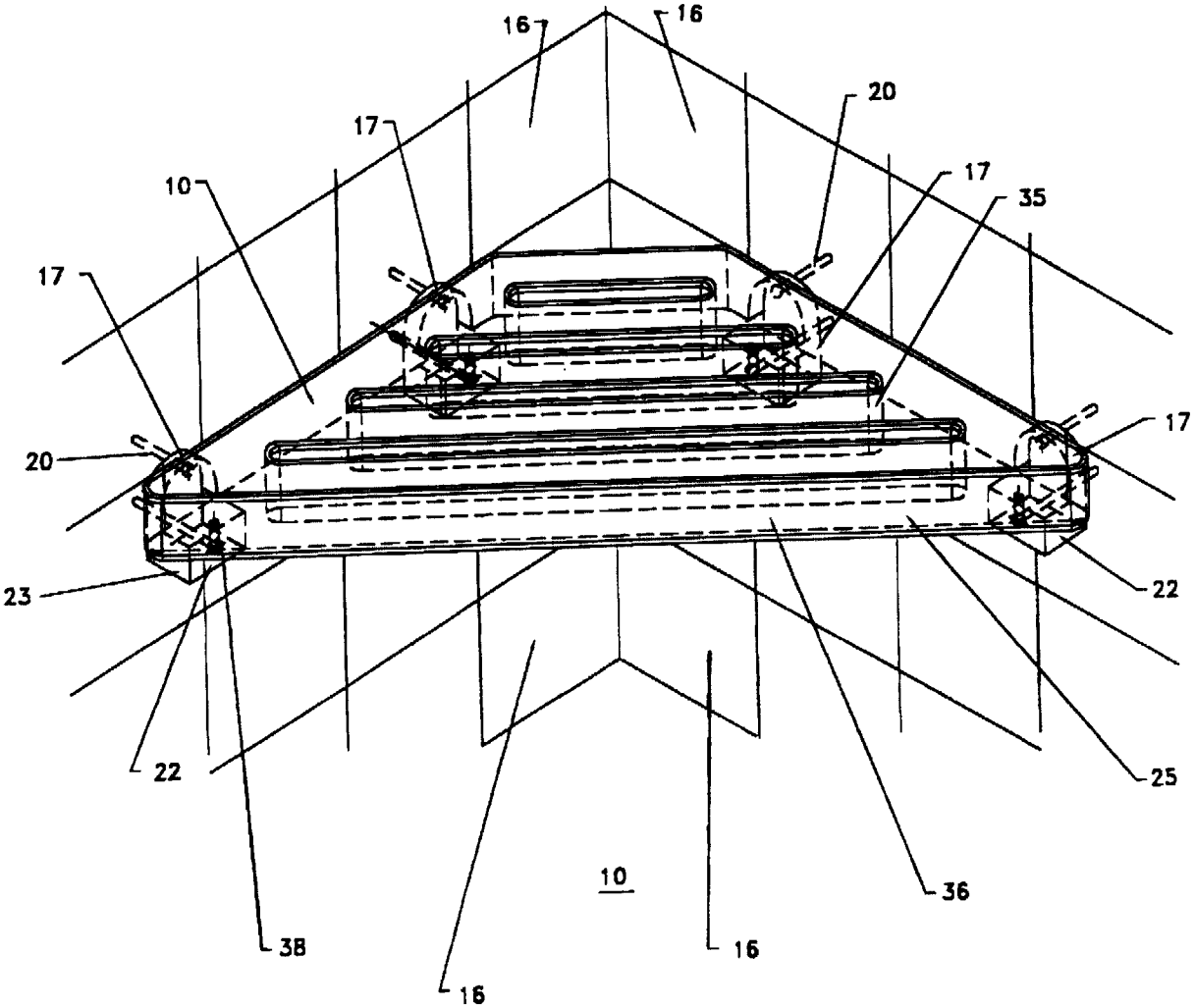
FIG. 2 is a perspective view, enlarged, in partial phantom of the seat of FIG. 1.
Figure 3:
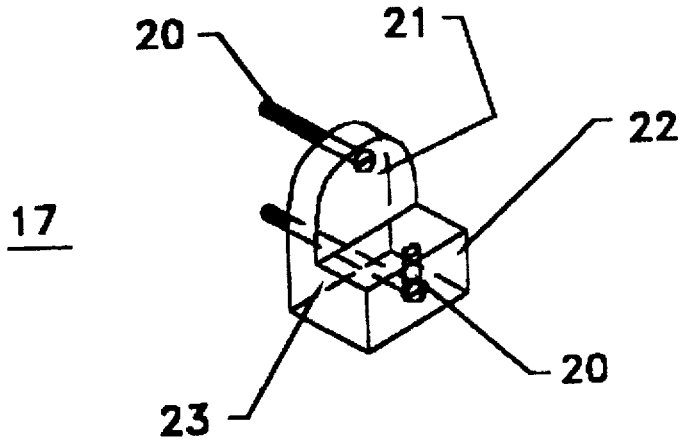
FIG. 3 is a view in perspective of a mounting bracket used with the seat of FIG. 1.
Figure 4:
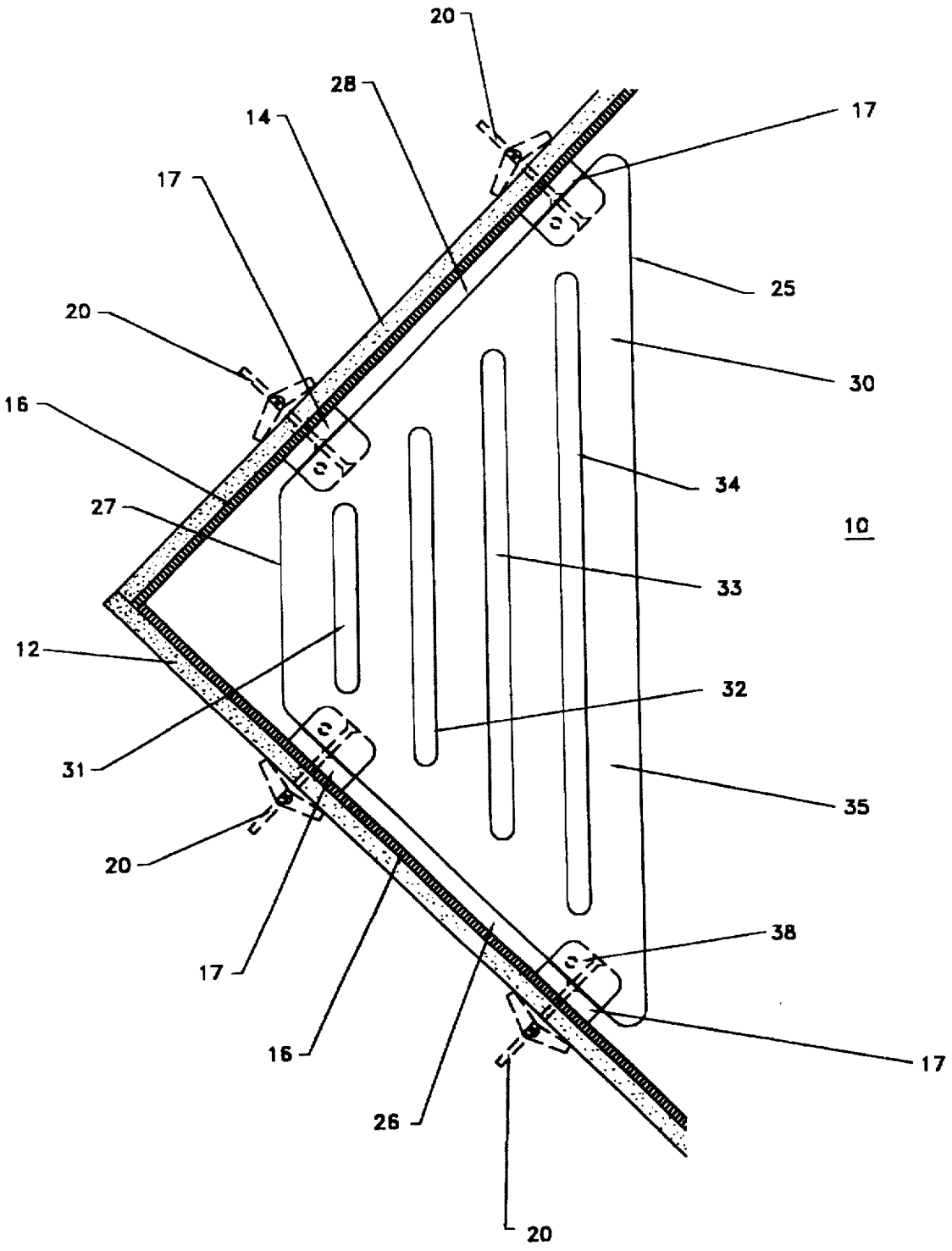
FIG. 4 is a top plan view, enlarged, in partial section, of one embodiment of the seat of the invention.

It should, of course, be understood that the description and drawings herein are merely illustrative, and that various modifications and changes can be made in the structures disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents which operate and function in substantially the same way to bring about the same result.

Referring now more particularly to FIGS. 1–4 of the drawings, one embodiment of the corner seat 10 of the invention is therein illustrated. The seat 10 is mounted in a corner of a shower stall 11 which has intersecting walls 12 and 14, and a floor 15. The walls 12, 14 and floor 15 are faced with a plurality of ceramic tiles 16 of well known type.

The seat 10 is mounted on brackets 17, which are secured to walls 12 and 14 by toggle bolts 20 of well known type. The brackets 17, four being illustrated, are of L shape with rounded top panels 21, and integral bottom panels 22 with flat surfaces 23 which face the seat 10.

The brackets 17 can be made of any suitable material such as Avonite® or Fountainhead® synthetic plastic with Corian® synthetic plastic available from E. I. Dupont DeNemours, Wilmington Del. being a preferred material.

The seat 10 is of a generally trapezoidal configuration with a straight front wall 25, left side wall 26, rear wall 27, and right side wall 28. The seat 10 is provided with a flat top surface 30, which is intended for the user to sit on. The top surface 30 is provided with a plurality of elongated transverse openings 31, 32, 33, and 34, which extend through the body 35 of the seat 10, and through the bottom surface 36.

The openings 31, 32, 33, and 34 are provided so that water (not shown) on surface 30 will flow therethrough out onto floor 15, and then flow to a drain (not shown).

The bottom surface 36 along walls 26 and 28 sits on the surfaces 23 of brackets 17, and screws 38, preferably of stainless steel extend through the bottom panels 22 of brackets 17 into body 35 of seat 10 to retain the seat in place. The top panels 21 of brackets 17 are of approximately ¼ inch thickness, so that walls 26 and 28 of seat 10 are spaced from the shower stall walls 12 and 14, to permit water flow therebetween, and onto floor 15 for disposal. The rear wall 27 is parallel to the front wall 25 and also spaced from walls 12 and 14. The body 35 of seat 10 is preferably of one and one-half inch thickness and fabricated from one half inch thick panels of Corian® which are glued together in well-known manner to provide a seat 10 of increased strength. The number of panels and their thickness is determined by the fabricator, and if desired the seat 10 could be made of one panel of one and one half inches or thicker. In addition, the use of multiple panels permits the fabricator to achieve a variegated and pleasing pattern by using different color panels.

Figure 5:
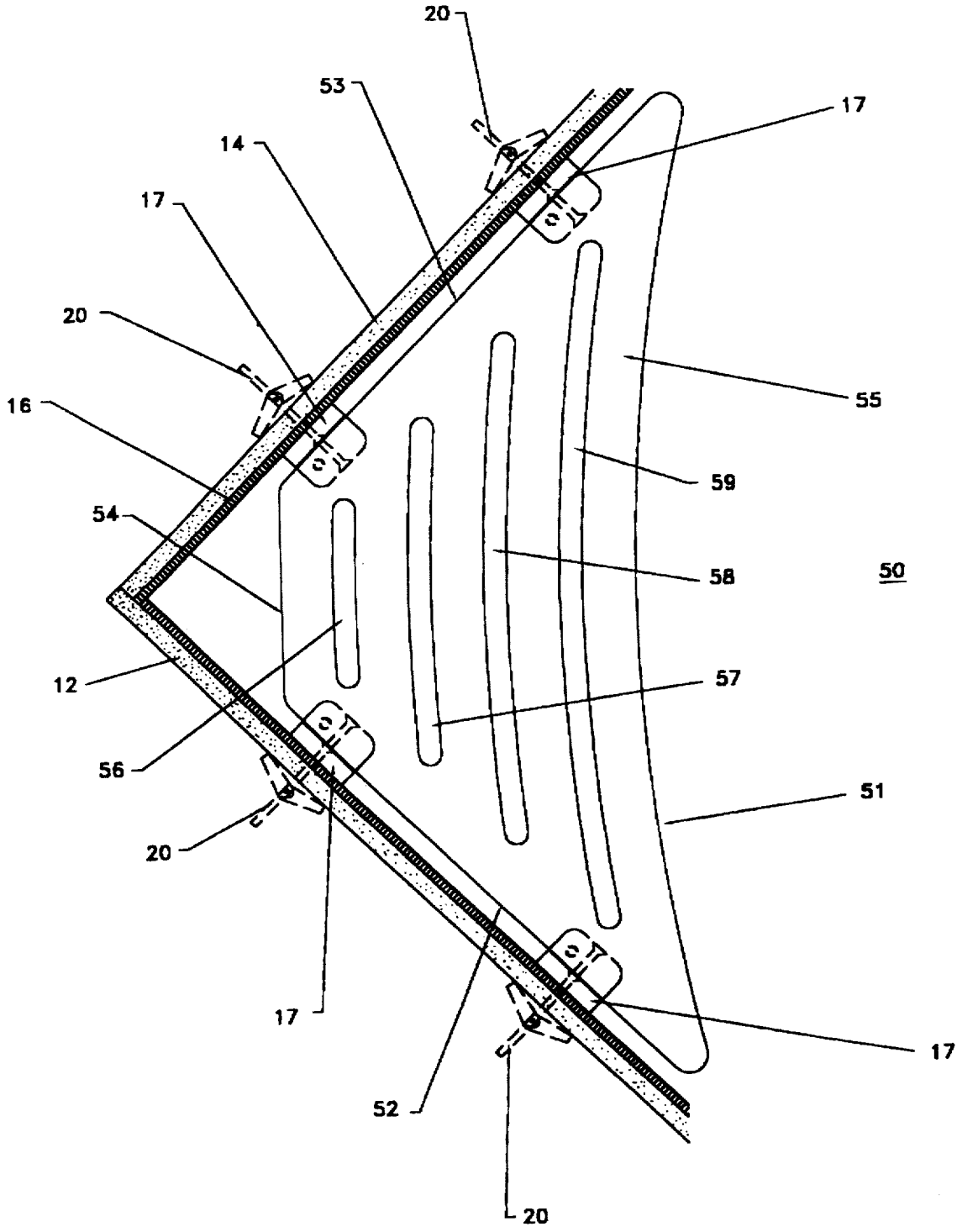
FIG. 5 is a view similar to FIG. 4, of another embodiment of the seat of the invention.

Referring now to FIG. 5 an alternate embodiment of seat 50 is illustrated which uses brackets 17 as described above. The seat 50 has a front wall 51 which is curved as it goes from side walls 52 to 53, which are similar to sidewalls 26 and 28, and connected at the rear by straight wall 54. The seat 50 has a top surface 55, similar to surface 30, with transverse openings 56, 57, 58 and 59 which are essentially parallel to front wall 51. The remaining construction and features of seat 50 are similar to seat 10. It will thus be seen that structures have been provided with which the objects of the invention are achieved.

I claim:

1. A corner seat of synthetic plastic material for supporting a person and for detachable mounting to the vertical intersecting walls of a shower stall or tub enclosure which comprises;

a substantially trapezoidal laminated body having a front wall, left and right side walls and a rear wall, a plurality of transverse elongated openings extending through said body, and a plurality of synthetic plastic L-shaped brackets having a curved upper end to enable water to flow thereover adapted to be secured to said stall or tub enclosure walls, to engage and support said seat, and to space said seat from said shower stall or tub enclosure walls such that a gap is present between said side walls and said stall or tub enclosure walls in order to enable water to pass therethrough.

2. A corner seat as defined in claim 1 in which:

said rear wall is parallel to said front wall.

3. A corner seat as defined in claim 1 in which:

said front wall is curved inwardly between said side walls.

4. A corner seat as defined in claim 1 in which:

said plastic material is CORIAN plastic.

* * * * *